US007707856B2

(12) United States Patent
Wang

(10) Patent No.: US 7,707,856 B2
(45) Date of Patent: May 4, 2010

(54) TAKE-OFF COMB ELEMENT

(75) Inventor: Zhiyong Wang, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/314,944

(22) Filed: Dec. 19, 2008

(65) Prior Publication Data

US 2009/0158780 A1 Jun. 25, 2009

(30) Foreign Application Priority Data

Dec. 20, 2007 (EP) ..... 07 024 749

(51) Int. Cl.
*D04B 15/90* (2006.01)

(52) U.S. Cl. ..... 66/149 R

(58) Field of Classification Search ..... 66/149 R, 66/152, 147

See application file for complete search history.

(56) References Cited

U.S. PATENT DOCUMENTS

| | | | | |
|---|---|---|---|---|
| 3,255,783 A | | 6/1966 | Wall | |
| 3,336,888 A | | 8/1967 | Inui | |
| 3,375,683 A | * | 4/1968 | Pierre | 66/149 R |
| 3,376,716 A | * | 4/1968 | Pierre | 66/150 |
| 3,618,343 A | * | 11/1971 | Essig | 66/149 R |
| 4,488,416 A | * | 12/1984 | Shima et al. | 66/149 R |
| 4,503,690 A | * | 3/1985 | Goller et al. | 66/149 R |
| 5,040,384 A | | 8/1991 | Shima | |
| 5,241,841 A | | 9/1993 | Schmid et al. | |
| 5,899,094 A | * | 5/1999 | Ikoma | 66/149 R |
| 6,155,082 A | * | 12/2000 | Schimko et al. | 66/149 R |
| 7,421,861 B2 | * | 9/2008 | Danner et al. | 66/149 R |
| 2007/0180864 A1 | | 8/2007 | Danner et al. | |

FOREIGN PATENT DOCUMENTS

| | | |
|---|---|---|
| BE | 524809 | 12/1953 |
| DE | 102006005384 | 8/2007 |
| EP | 40 03 667 | 8/1990 |
| EP | 0 477 483 | 4/1992 |

* cited by examiner

*Primary Examiner*—Danny Worrell
(74) *Attorney, Agent, or Firm*—Fitch, Even, Tabin & Flannery; Norman N. Kunitz

(57) ABSTRACT

A take-off element (10) for the gentle treatment of thread and for simple handling comprises two parts (11, 12), wherein at least one of said parts is arranged so as to be adjustable in longitudinal direction relative to the other. Whereas one of the parts 11 has a longitudinal slit for receiving a thread, the other part is provided with a head (34) extending on one side away from the shaft (35), the head being movable from the outside to the thread-receiving opening (26) in order to close the opening and away therefrom in order to clear the opening. The head (34) has an oblique surface (37) which is disposed to close the thread-receiving opening (26). The new take-off element (10) does not have a hook and thus does not exhibit any problem regarding process reliability. Its part (12) has a robust slider head, thus avoiding potential deformations on the head. Considering process reliability, the take-off element (10) permits a perfect insertion and removal of the comb thread (25) of a knit fabric.

13 Claims, 5 Drawing Sheets

TAKE-OFF COMB ELEMENT

CROSS-REFERENCE TO RELATED APPLICATION

The present application claims the priority of European Patent Application No. 07 024 749.9, filed Dec. 20, 2007, the subject matter of which, in its entirety, is incorporated herein by reference.

BACKGROUND OF THE INVENTION

The invention relates to a take-off element for a take-off comb for a knitting machine or loop-forming machine.

In a knitting machine or loop-forming machine the stitches must be pulled off the needles after the stitch-forming operation. Frequently, a take-off comb is used for the start of the knit fabric. This comb is disposed to grasp the first row of stitches and pull them away from the knitting site in a controlled manner.

Such a take-off comb has been known, for example, from DE 10 2006 005 384 A. This comb comprises take-off elements that are held in a base body and are oriented parallel to each other, whereby said elements are provided with a head at their ends. This head acts as a hook. A slider is accommodated in the take-off element so as to be movable in longitudinal direction. This slider has a sharp end pointing at the head, which end can be pushed toward the head and away therefrom in order to close or open a thread-enclosing space.

A similar take-off element is known from EP 0 477 484 B1. In this case the take-off element provided with a head accommodates a slider that has a finger-like extension. The take-off element is provided with an opening that is diagonally oriented to the longitudinal direction and is delimited on parallel flanks, whereby the finger-like extension may extend through said opening in order to close or clear a thread-enclosing space.

The same literature reference also discloses a thread-take-off element that uses a hook supported in the thread take-off element for thread enclosure. This hook is provided on a slider. The hook tip may be pushed in or out of the thread-receiving space.

Furthermore, such an arrangement has been known from DE 40 03 667 C2. Again, a slider supported in the take-off element and being provided on the end side with a hook is used for grasping and releasing the thread.

When such take-off combs and take-off elements are used, neither the threads nor the take-off elements are to be subjected to excessive stress or even damage.

SUMMARY OF THE INVENTION

Therefore, it is the object of the invention to provide take-off elements that are robust and are gentle on the thread. This object generally is achieved with the take-off element in accordance with the invention that comprises a first part that has a thread-receiving opening. In addition, the take-off element comprises a second part with a head that is disposed to close the thread-receiving opening of the first part when both parts are moved relative to each other. The thread-receiving opening extends away from the head, and the head has an oblique surface facing the thread-receiving opening.

If the thread-receiving opening is open, i.e., for receiving or also for releasing a thread, the head is located at a distance from and in front of the thread-receiving opening. Considering the longitudinal direction of the parts, the head is moved away from the thread-receiving opening in longitudinal direction and is thus positioned longitudinally in front of the opening. When the thread-receiving opening is closed, the head is immersed at least a minimal distance into the thread opening in order to block said opening.

The oblique surface provided on the head acts as a sliding surface. It is oriented obliquely relative to the longitudinal direction of the individual parts of the take-off element. Preferably, said surface forms an acute angle with the slide-out direction of the second part that bears the head.

The first part and the second part are arranged so that they can be shifted relative to each other. In so doing, the term "longitudinal" refers to the longitudinal direction of the elongated parts and, at the same time, to the shifting direction of the two parts relative toward each other. Preferably, the two parts are supported against each other, for example, in that a first part of the two parts is supported in a longitudinally extending hollow space or channel of the second part of the two parts. In so doing, the second part may be fully or partially U-shaped, L-shaped or even be designed so as to be closed in cross-section all around along its entire longitudinal extension or a part thereof. In other words, the channel for the accommodation of the first part may be open at one or more points or also be closed across its longitudinal direction.

The thread-receiving opening of the second part preferably extends toward said part's free end and thus terminates at the face of the second part. Preferably, the thread-receiving opening comprises a section extending in longitudinal direction of the second part. This section is oriented parallel to, or at an acute angle, relative to the longitudinal direction. Preferably, the thread-receiving opening widens toward the face end of the second part. This can be achieved in that the thread-receiving opening of the second part has a funnel-shaped edge. Such an edge can be formed in that the flank of the thread-receiving opening that is initially oriented parallel to the longitudinal direction is provided in the end region—located in the region of the opening—at an acute angle relative to the longitudinal direction. It is sufficient if this is applicable to that flank of the thread-receiving opening that is located opposite the second part or a thin rod section thereof. In so doing, the thread can be guided between the respective flank and the first part or its head into and out of the thread-receiving opening.

Preferably, the head of the first part has an oblique surface that is adapted to the flank or to the edge of the thread-receiving opening. This adaptation may comprise, e.g., the feature that the oblique surface of the first part is oriented essentially parallel to the edge of the second part.

On the opposite side the head may be provided with a top surface that is inclined in the inverse direction relative to the oblique surface. In other words, the oblique surface and the top surface subtend an acute angle together with the longitudinal direction, whereby the vertices of these two acute angles face away from each other.

Additional details of advantageous embodiments of the invention are the subject matter of the drawing, the description and the claims. The description is restricted to essential aspects of the invention and miscellaneous situations. The drawings disclose additional details and are to be referred to as being supplementary.

DETAILED DESCRIPTION OF THE INVENTION

Figure 1:
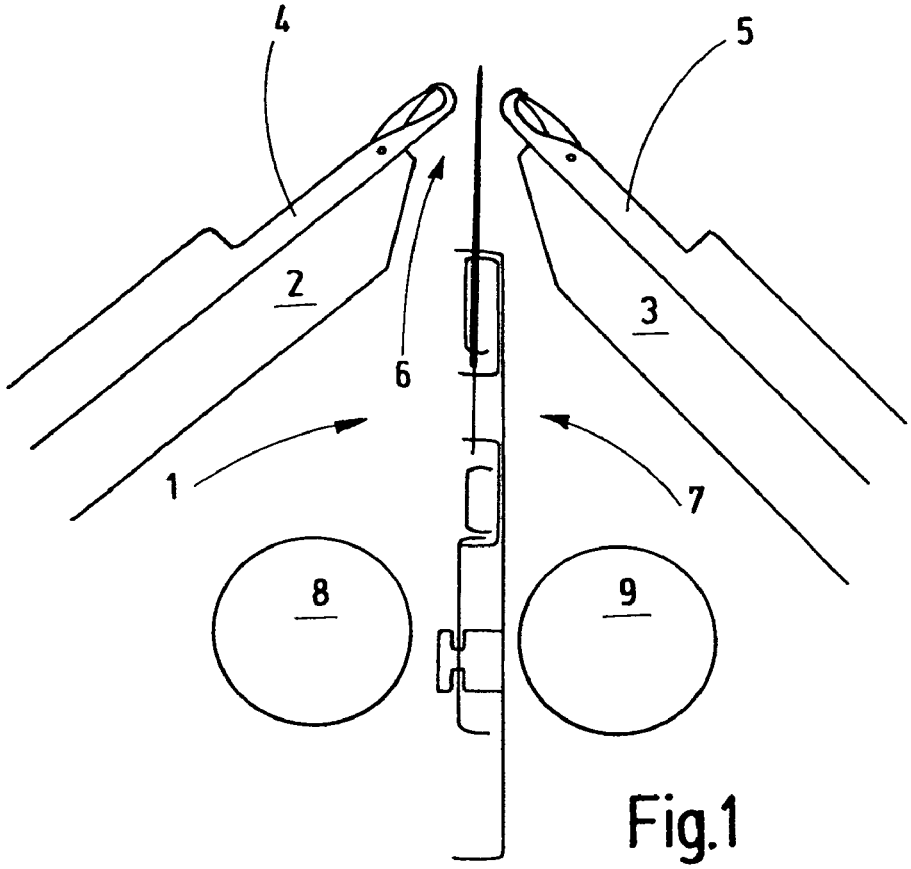
FIG. 1 is a simplified illustration, vertically in section, of a knitting machine and a take-off device.

FIG. 1 shows a take-off comb 1 on a knitting machine that is configured as a flat-bed knitting machine and uses two needle beds 2, 3. Each of the needle beds 2, 3 comprises two parallel needle channels with needles 4, 5 supported therein, said needles being used to produce a knit fabric. Cams for driving the needles 4, 5 do exist, however, are not illustrated. Between the needle beds 2, 3 and the needles 4, 5 is a comb space 6 in which a take-off comb 7 may enter from the bottom. At that location, it is also possible to provide additional take-off means such as, for example, two take-off rollers 8, 9 that may come into engagement with the knit fabric when the knit fabric has been moved downward far enough by means of the take-off comb 7.

Figure 2:
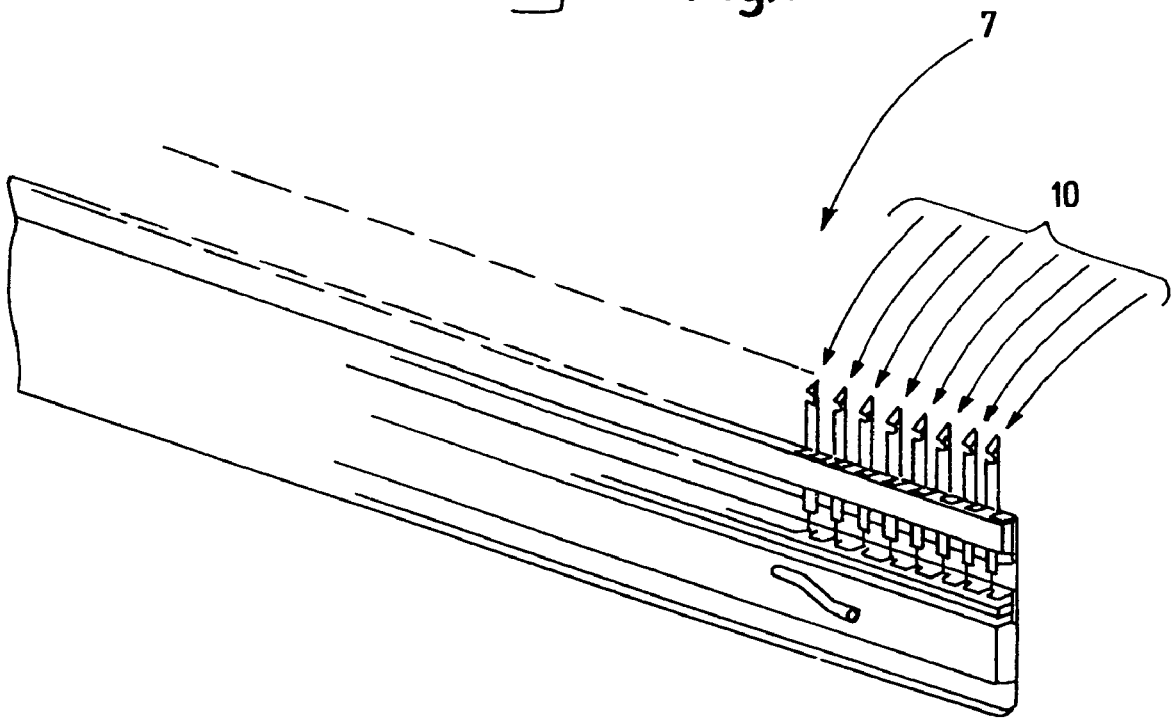
FIG. 2 is a perspective schematic representation of a take-off comb in accordance with FIG. 1.

FIG. 2 shows the take-off comb 7 by itself. This comb has a row of take-off elements 10 that are arranged next to each and are the same. The take-off comb 1 is shown again in FIG. 3. Said comb maintains the take-off elements 10 in parallel alignment at a distance from each other. The take-off elements 10 are elongated and each consists of at least two parts 11, 12 that are supported so as to be movable relative to each other in a longitudinal direction 13. To achieve this, the first part is stationarily supported on an appropriate bed 14. The bed 14, for example, is a bent sheet metal component with teeth, between which the first part 11 is set. The second part 12, for example, is set on a rail 15 that can be moved toward the bed 14. The specific adjustment of the rail 15 in longitudinal direction 13 is achieved with a suitable drive 16, for example, configured as a rail 17 that can be shifted in a direction transverse to the longitudinal direction 13. The rail 15, e.g., is connected to a foot of the second part 12 in order to move said second part relative to the part 11.

Figure 3:
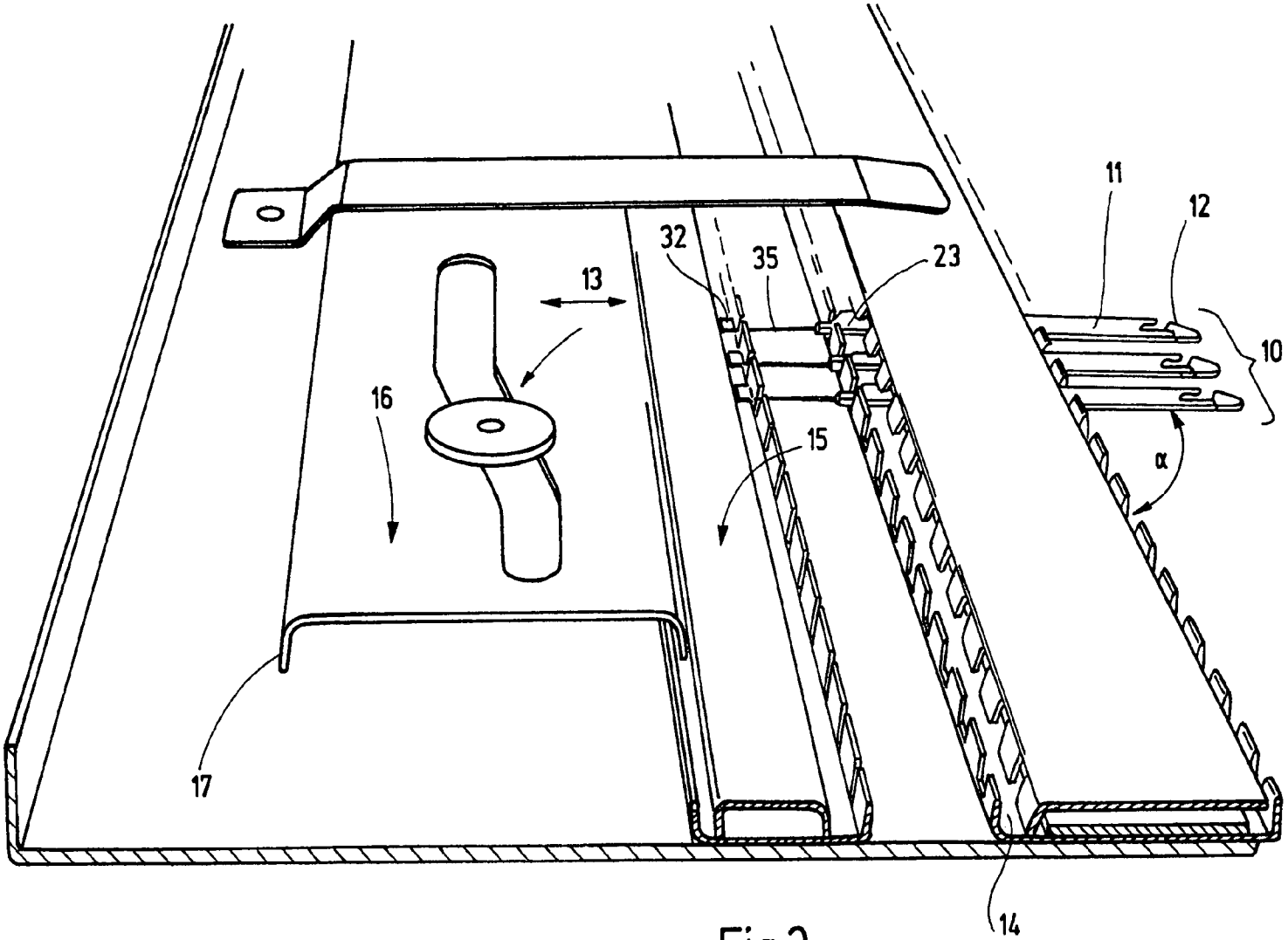
FIG. 3 is a perspective view of the take-off comb in accordance with FIG. 2.
Figure 5:
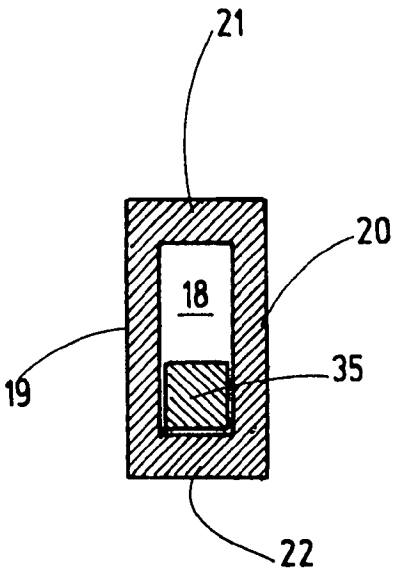
FIG. 5 is a sectional view, along line V-V of the take-off element in accordance with FIG. 4.
Figure 4:
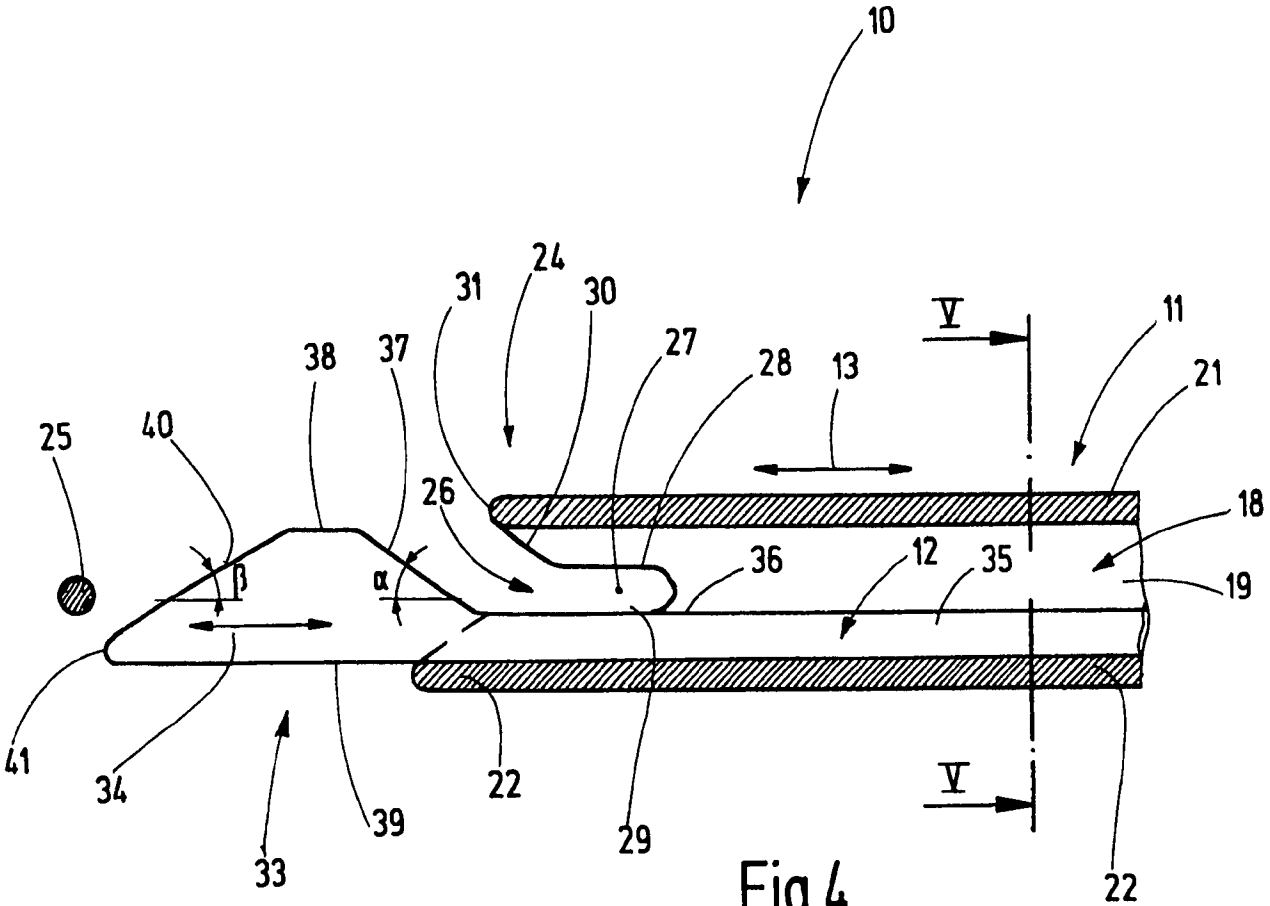
FIG. 4 is a longitudinal section of a take-off element as arranged in a large number in the take-off comb in accordance with FIG. 3.

One take-off element 10 is illustrated as being representative of all those illustrated in FIG. 4 in longitudinal direction and in FIG. 5 in cross-section. Its second part 11 forms an elongated body that comprises a channel 18 that is continuous in longitudinal direction. As is shown by FIG. 5, the channel 18 has, for example, a rectangular cross-section and is delimited by two lateral walls 19, 20, as well as by two narrow-sided walls 21, 22. Referring to the present exemplary embodiment, the second part 11 is thus configured as a rectangular pipe. Its end 23 (see FIG. 3) that is set in the bed 14 is not shown in FIG. 4. The other end 24 (FIG. 4) is disposed to receive a thread 25. To accomplish this, said end has a thread-receiving opening 26 that extends from the face end 24 into the second part 11 and, in so doing, extends through the lateral walls 19, 20, in particular.

The thread-receiving opening 26 has a slit-like section 27 that is delimited by two preferably straight flanks 28, 29. The closed end of the section 27 is preferably formed by a rounded arch that connects the flanks 28, 29 to each other. Toward its open end 24, the thread-receiving opening 26 widens. Whereas the flank 29 is straight up to the end 24, the flank 28 preferably terminates in a slightly curved manner in an inlet section 30 that diverges away from the flank 28. The inlet section 30 ends at the wall 21. Below this end point 31, the flank 29 may start diverging toward the wall 22. This may be achieved in a curved, oblique or otherwise expedient form. In contrast, the inlet section 30 is preferably essentially straight. In so doing, a funnel-shaped mouth is formed between the flank 29 and the inlet section 30.

The first part 12 is supported so as to be shiftable in channel 18. The end 32 of the first part in engagement with the rail 15 is shown by FIG. 3, however, is not shown by FIG. 4. The first part 12 extends through the channel 18, and its one end 33 projects from the end of the channel 18, as shown by FIG. 4. Whereas the end 33 forms a head 34, the first part 12 continues—extending from the head 34—as a straight shaft 35 through the channel 28. The preferably straight back of the shaft 35 abuts against the preferably also straight wall 22. In the region of the thread-receiving opening 26, said shaft's height measured from that point is preferably the same or slightly less than the distance of the inside surface of the wall 22 from the flank 29. Outside the thread-receiving opening 26, the shaft 35 of part 12 may have a height that is different therefrom, in particular, a greater height.

At least adjoining the head 34, the shaft 35 has—at its site next to the thread-receiving opening 26—a straight front 36 that is arranged parallel to the flank 29 or is in alignment or congruent therewith. Adjoining this front, the head 34 has an oblique surface 37 which, preferably, essentially follows a straight line. In contrast, the oblique surface 37 may terminate in the front 36 by way of a curvature. The oblique surface 37 is inclined at an acute angle $\alpha$ against the longitudinal direction 13. This angle opens away from the end 24 of the second part 11 and thus its vertex faces the thread-receiving opening 26, i.e., the first part 12.

The oblique surface 37 of the first part 12 is preferably oriented approximately parallel to the inlet section 30 of the second part 11. This need not be perfectly parallel. A few degrees of angular deviation are acceptable and useful in some cases.

The head 34 has a height which is preferably less than the distance between the walls 21, 22. The oblique surface 37 terminates in a plateau 38 that is preferably arranged approximately parallel to the back 39 of the first part 12. In so doing, the head 34 may move into the channel 18—partially or fully—if needed.

With a rounded section, the plateau surface 30 terminates in a top surface 40 that extends up to the extreme tip 41 of the head 34. The top surface 40 may be rounded or, as shown, consist of straight sections, or overall, of a single straight surface. Together with the longitudinal direction 13, said surface subtends an acute angle $\beta$ whose vertex faces away from the second part 12. Consequently, the angles $\alpha$ and $\beta$ face in different directions. In other words, the oblique surface 37 and the top surface 40 are inclined in different directions, i.e., independent of whether they have a straight or curved configuration.

The width of the first part 12 is smaller than the internal distance of the lateral walls 19, 20 from each other, so that a certain play exists, as is obvious from FIG. 5. This makes it possible for the parts 11, 12 to be shifted relative to each other and into each other in longitudinal direction.

Figure 6:
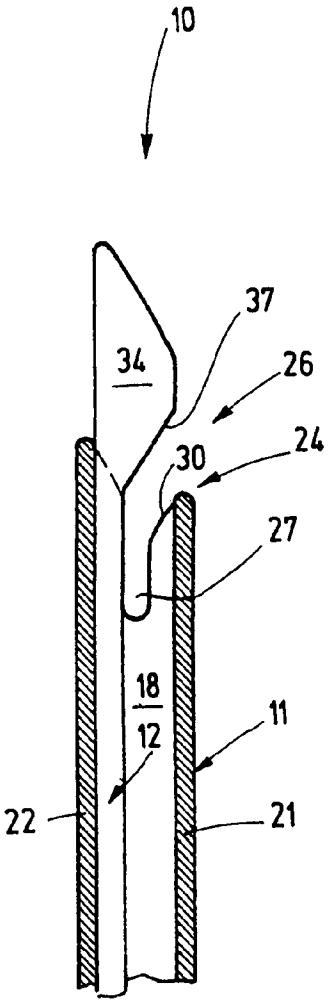

The take-off element 10 described so far is disposed to work during take-up, enclosure and release of the thread 25 as is obvious from FIGS. 6 through 10:

In order to take up the thread the first part 12 is shifted relative to the second part 11, in accordance with FIG. 6. In so doing, the head 34 moves out of the end 24 of the first part 11. Its oblique surface 37 forms, with the inlet section 30, a wide, preferably somewhat parallel-flanked, delimited gap that terminates in the section 27 of the receiving opening 26 and is at an oblique angle with respect thereto. In this state, the thread 25 may move into the thread-receiving opening 26, as is shown by a series of arrows 42. In so doing, it is not possible for the thread 25 to be caught at an edge, a hook or any other part of the take-off element 10.

Figure 9:
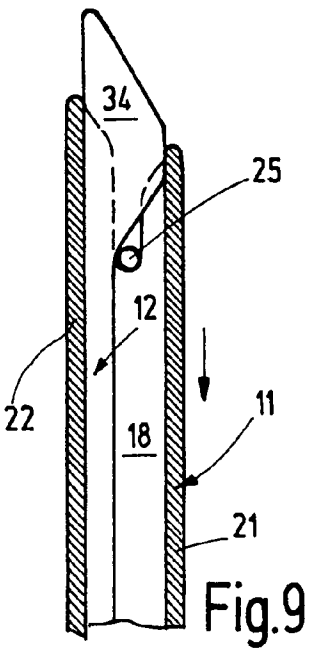
Figure 8:
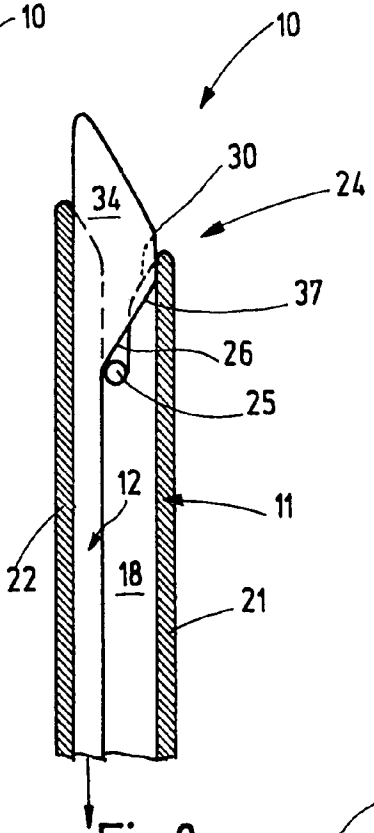
Figure 7:
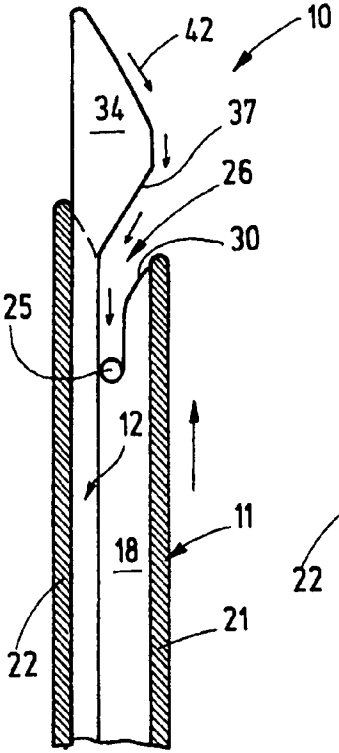

When the thread 25 has been received by the thread-receiving opening 26, the parts 11, 12—as indicated by the arrow in FIG. 8—are moved relative to each other, so that the head 34—as indicated in FIG. 8—penetrates into the end 24 of the second part 11. In so doing, the oblique surface 37 enters the channel 18 and arrives behind the inlet section 30. In so doing, the thread-receiving opening 26 is closed and the thread 25 is trapped therein. In this condition, the knit fabric comprising the thread 25 can be taken off as indicated in FIG. 9.

Figure 10:
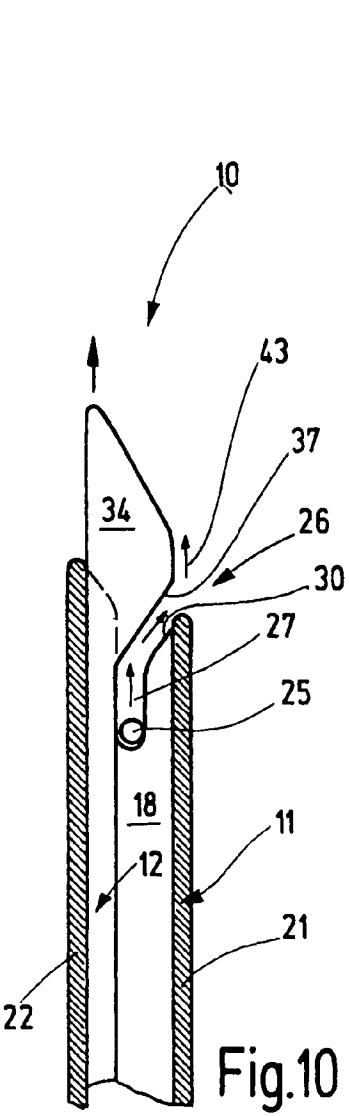
FIGS. 6 through 10 show the take-off element in accordance with FIG. 4 in various phases of grasping and releasing the thread.

The thread 25 may be released as shown by FIG. 10. To accomplish this, the parts 11, 12 are again moved toward each other in such a manner that the head 34 moves out of the channel 18 and that the oblique surface 38 delimits a gap with the inlet section 30. This gap preferably has a size at least equal to the width of the section 27. The thread-receiving opening 26 is thus cleared. The thread 25 may slide out of the thread-receiving opening 26, as indicated by a series of arrows 43.

Neither on its path into the thread-receiving opening 26 (FIG. 7) nor on its path out of the thread-receiving opening 26 (FIG. 10) is it possible for the thread 25 to become caught on parts of the take-off element 10, to bend said element or cause any other wear. In addition, the thread 25 is treated gently. It can neither be pierced nor torn.

Figure 12:
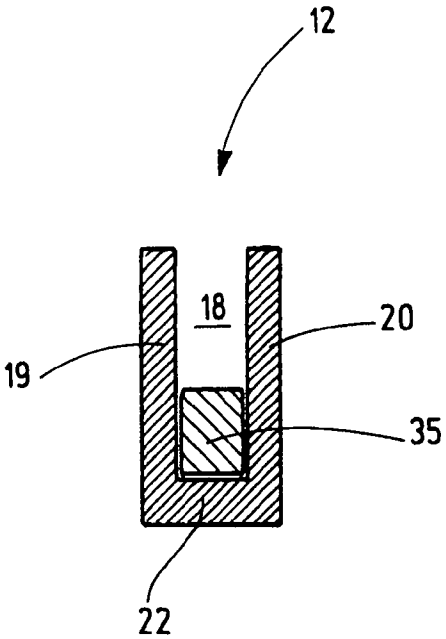
FIG. 12 is a sectional view, along line XII-XII, of the take-off element in accordance with FIG. 4.
Figure 11:
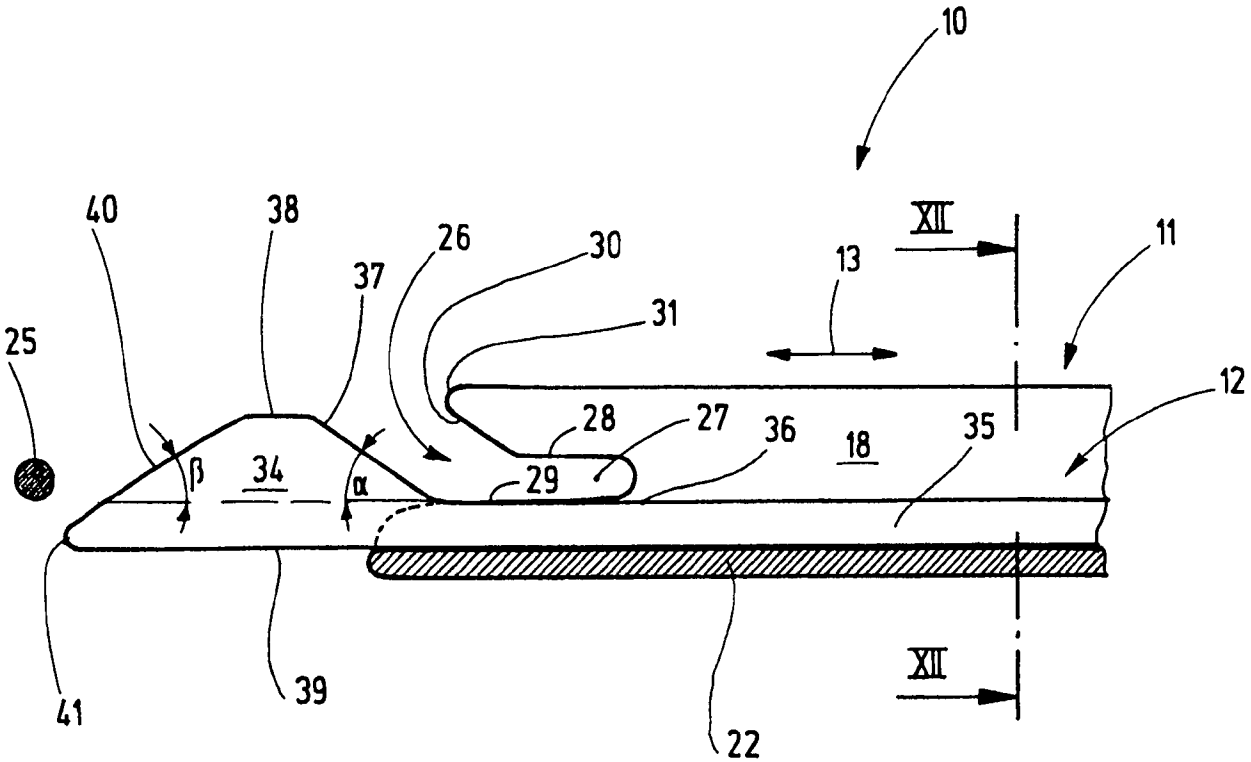
FIG. 11 is a side view, in section, of an alternative embodiment of the take-off element.

The described embodiment may be modified. For example, FIG. 11 shows an embodiment with a partially open channel 18. Referring to this embodiment, parts of the otherwise existing wall 21 have been omitted. Thus, in accordance with FIG. 12, the part 12 is configured as an open U-profile. Other than that, the above description applies analogously with reference to the same reference signs.

A take-off element 10 for the gentle treatment of the thread and for simple handling comprises two parts 11, 12, whereby at least one of said parts is arranged so as to be adjustable in longitudinal direction relative to the other. Whereas one of the parts 11 has a longitudinal slit 27 for receiving a thread 25, the other part 12 is provided with a head 34 extending on one side away from the shaft 35, said head being movable from the outside to the thread-receiving opening 26 in order to close said opening and away therefrom in order to clear said opening. The head 34 has an oblique surface 37 which is disposed to close the thread-receiving opening 26. The new take-off element 10 does not have a hook and thus does not exhibit any problem regarding process reliability. Its part 12 has a robust slider head, thus avoiding potential deformations on the head. Considering process reliability, the take-off element 10 permits a perfect insertion and release of the thread 25 of a knit fabric.

It will be appreciated that the above description of the present invention is susceptible to various modifications, changes and modifications, and the same are intended to be comprehended within the meaning and range of equivalents of the appended claims.

LIST OF REFERENCE NUMERALS

1 Take-off comb
2, 3 Needle beds
4, 5 Needles
6 Comb distance
7 Take-off comb
8, 9 Take-off rollers
10 Take-off element
11 Second part
12 First part
13 Longitudinal direction
14 Bed
15 Rail
16 Drive
17 Rail
18 Channel of the second part 11
19, 20 Lateral walls
21, 22 Walls
23, 24 Ends of the second part 11
25 Thread
26 Thread-receiving opening
27 Section of the thread-receiving opening 26
28, 29 Flanks of the thread-receiving opening 26
30 Inlet section of the thread-receiving opening 26
31 End point of the inlet section 30
32, 33 Ends of the first part 12
34 Head of the first part 12
35 Shaft of the first part 12
36 Front of the shaft 35
37 Oblique surface of the head 34
38 Plateau surface of the head 34
39 Back of the first part 12
40 Top surface
41 Tip
42, 43 Arrows

What is claimed is:

1. Take-off element comprising:

a second part having a free end and a thread-receiving opening that extends away from the free end, a first part disposed adjacent said second part for relative movement in a longitudinal direction, and having a head that is positioned adjacent said free end and by which the thread-receiving opening can be closed at the free end of the second part due to a relative movement of the first and second parts in the longitudinal direction, wherein the thread-receiving opening extends away from the head and has a section with opposed flanks extending in the longitudinal direction and an inlet section with diverging flanks disposed between the opposed flanks of said section and said free end of said second part, and wherein the head has an oblique surface facing a diverging flank of the thread-receiving opening.

2. Take-off element in accordance with claim 1, wherein the second part and the first part are arranged so as to be movable toward each other in the longitudinal direction.

3. Take-off element in accordance with claim 1, wherein the second part and the first part are arranged so as to be movable next to each other in the longitudinal direction.

4. Take-off element in accordance with claim 1, wherein the inlet section of the thread-receiving opening of the second part is funnel-shaped.

5. Take-off element in accordance with claim 1, wherein the head carried by the first part is arranged, with respect to the longitudinal direction, in front of the thread-receiving opening of the second part.

6. Take-off element in accordance with claim 4, wherein the oblique surface of the head of the first part is adapted to the shape of the inlet section.

7. Take-off element in accordance with claim 6, wherein the oblique surface of the head is oriented essentially parallel to one of the diverging flanks of the inlet section.

8. Take-off element in accordance with claim 1, wherein the head has, on its side facing way from the oblique surface, a top surface that is inclined in a direction (β) inverse to the direction of inclination (α) of the oblique surface.

9. Take-off element in accordance with claim 7, wherein the head has on its side facing way from the oblique surface, a top surface that is inclined in a direction (β) inverse to the direction of inclination (α) of the oblique surface.

10. Take-off element in accordance with claim 1 wherein said second part is a hollow element in which said first part is supported for sliding movement in the longitudinal direction.

11. Take-off element in accordance with claim 10 wherein said second part has a rectangular cross section and said thread-receiving opening is formed in each of two opposed side walls of the rectangular cross section.

12. Take-off element in accordance with claim 10 wherein said second part has a U-shaped cross section and said thread-receiving opening is formed in each opposed side wall of the U-shaped cross section.

13. Take-off element in accordance with claim 1 wherein said opposed flanks extending in the longitudinal direction are substantially parallel to one another and then diverge to said free end in said inlet section.

* * * * *